United States Patent [19]

Krieger

[11] Patent Number: 4,574,537

[45] Date of Patent: Mar. 11, 1986

[54] INSULATED PANEL AND METHOD OF CONSTRUCTING SAME

[76] Inventor: Steven R. Krieger, 150 S. Atlanta St., Roswell, Ga. 30025

[21] Appl. No.: 744,243

[22] Filed: Jun. 13, 1985

[51] Int. Cl.[4] ..... F16B 2/18; E04C 1/30

[52] U.S. Cl. ..... 52/127.9; 52/98; 52/285; 52/309.2; 52/309.8

[58] Field of Search ..... 52/127.9, 584, 285, 52/787, 309.2, 309.8, 98

[56] References Cited

U.S. PATENT DOCUMENTS

| | | | |
|---|---|---|---|
| 1,377,298 | 5/1921 | Wheeler | 52/787 |
| 2,580,231 | 12/1951 | Lamm | 52/714 X |
| 2,741,341 | 4/1956 | Anderson | 52/127.9 |
| 3,280,522 | 10/1966 | Palfey et al. | 52/285 X |
| 3,496,692 | 2/1970 | Melcher | 52/127.9 |
| 3,565,469 | 2/1971 | Zwart | 287/20.924 |
| 3,784,240 | 1/1974 | Berkowitz | 292/111 |
| 4,154,030 | 5/1979 | Huguet | 52/98 |
| 4,223,500 | 9/1980 | Clark et al. | 52/309.4 |
| 4,417,430 | 11/1983 | Loikitz | 52/584 |

FOREIGN PATENT DOCUMENTS

| | | | |
|---|---|---|---|
| 2448880 | 4/1976 | Fed. Rep. of Germany | 52/584 |
| 744723 | 2/1956 | United Kingdom | 52/285 |
| 2051911 | 1/1981 | United Kingdom | 52/714 |
| 159618 | 5/1964 | U.S.S.R. | 52/127.9 |

*Primary Examiner*—Alfred C. Perham

*Attorney, Agent, or Firm*—Thomas & Kennedy

[57] ABSTRACT

An insulated panel is provided with an embedded locking pin that is mounted to a plate placed flushly against a side of the insulated panel. An adjacent panel may be securely fastened by rotating a hook down into the insulation of the other panel and into locking engagement with the embedded locking pin.

8 Claims, 4 Drawing Figures

INSULATED PANEL AND METHOD OF CONSTRUCTING SAME

TECHNICAL FIELD

This invention relates generally to insulated panels of the type commonly used in forming cooler room walls, and more particularly to means for fastening together adjacent panels of this type.

BACKGROUND OF THE INVENTION

Walk-in type coolers, such as those commonly found in convenience stores today, are typically constructed of insulated wall, ceiling and floor panels that are fastened snugly together. The panels are usually comprised of foam insulation, such as expanded polystyrene and polyurethane encased within thin metallic sheets. The panel ends are shaped to fit together in tongue-and-groove fashion. They are provided with latch means for drawing and holding them snugly together. The latches themselves are commonly comprised of a hook assembly mounted to one panel for latching engagement with a pin assembly mounted to an adjacent panel. Kason Industries, Inc. of Shenandoah, Ga. manufactures and sells one line of such hook and pin type panel fasteners. Similar latches are shown in U.S. Pat. Nos. 3,565,469, 4,223,500, and 4,417,430. Some of these are formed in situ during formation of the insulation into the shape of blocks while others are designed to be mounted to the panels after they have been formed.

The latches used in interlocking adjacent panels together have had problems associated with their incorporation and use. For example, where the latch members have not been formed in-situ as the insulation is formed into blocks, a cavity has had to be cut into the insulation to receive the hook and pin assemblies. This has been tedious and inefficient and has often resulted in an unsightly product. Also, regardless of the method of incorporation, when the latch hook has been rotated into gripping engagement with the pin, only the local area of the panel about the bar assembly has been drawn snugly against the other panel.

Accordingly, it is a general object of the present invention to provide an insulated panel with an improved interlock mechanism which overcomes the just described problems associated with those of the prior art latches, and to provide an improved method of constructing such insulated panels.

SUMMARY OF THE INVENTION

In one form of the invention an insulated panel, which is adapted to be interlocked with an adjacent panel that has a pivotable locking hook, comprises a block of insulation and a lock bar mounted to a plate that is set flush against one side of the block. The lock bar is embedded within the block of insulation adjacent the opposite side of the panel. So constructed, the adjacent panel may be interlocked with the insulated panel by pivoting its locking hook into the block of insulation and into locking engagement with the embedded lock bar.

In another form of the invention, a method of constructing an insulated panel of the type adapted to be interlocked with an adjacent panel that has a pivotable locking hook comprises the steps of providing a block of insulation and a lock bar mounted to a plate. The lock bar and plate is mounted to the block of insulation by embedding the lock bar within the insulation and positioning the plate flushly against a side of the block.

DETAILED DESCRIPTION

Figure 1:
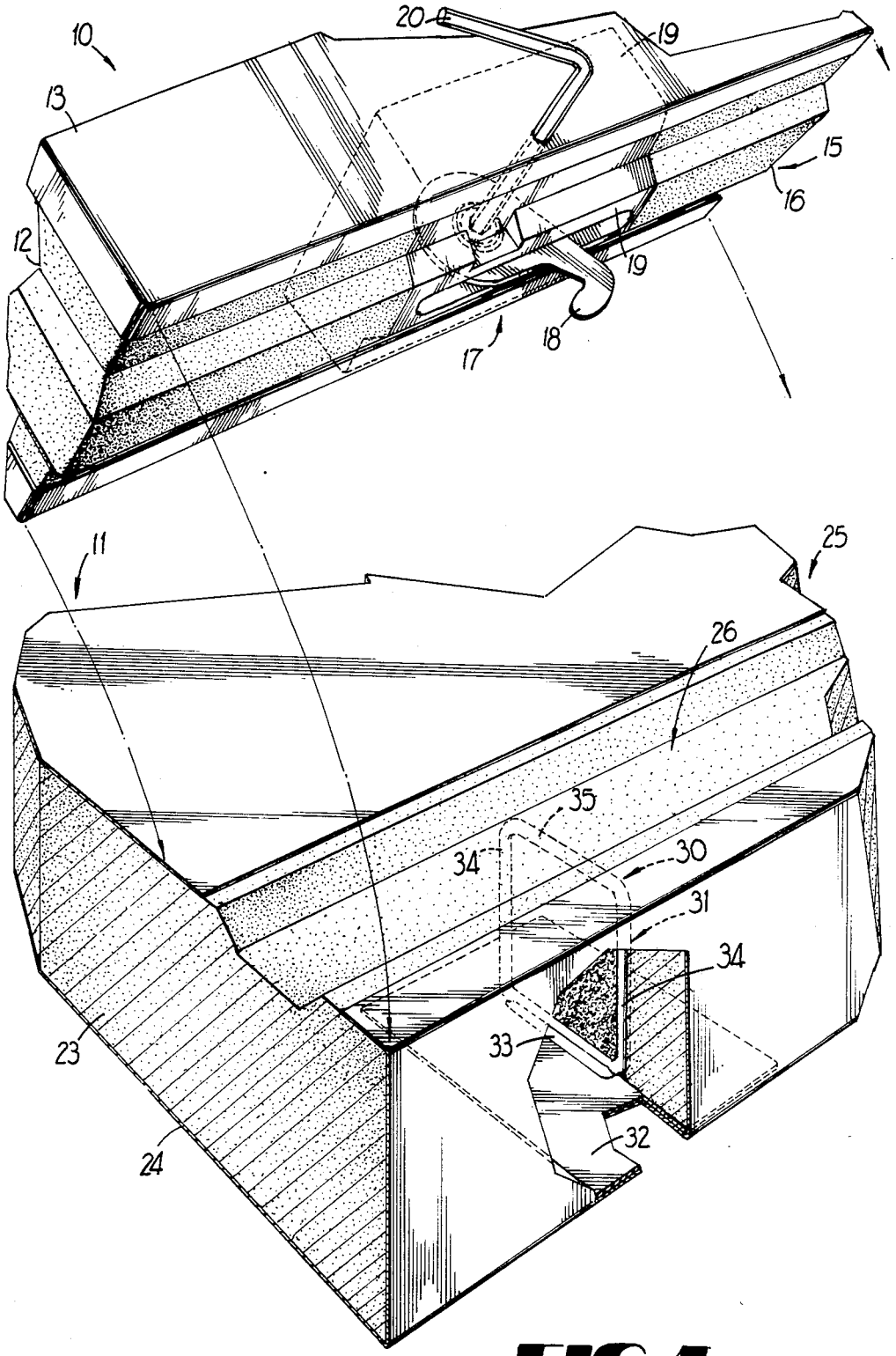
FIG. 1 is a perspective view of portions of two insulated panels shown positioned adjacent one another preparatory to being interlocked.

With reference next to the drawing, there is shown in FIG. 1 an insulated panel 10 shown positioned above another insulated panel 11 preparatory to being fastened thereto. The panel 10 is comprised of a block of foam insulation 12, such as expanded polystyrene or polyurethane, which is partially encased within a sheet metal cover 13. The cover is seen to have a gap along an end 15 of the block 12 which end is formed with a raised tongue 16. A conventional, rotatable hook type panel fastener, indicated generally at 17, is mounted in a conventional manner within the block of insulation 12 with a rotatable, metallic hook 18 shown rotated to an exposed position outside of its casing 19 by means of an L-shaped wrench 20. The hook type fastener 17, which may be a Kason model number 1153, is constructed with a keyway 37 that is linked with the hook 18 in an overcenter manner such that its rotation causes the hook to rotate and retract. The aforementioned U.S. Pat. No. 4,417,430 details one such hook assembly.

With continued reference to FIG. 1, the panel 10 is adapted to be fastened to panel 11 at a right angular relation, as where one panel forms a wall panel and another panel forms a ceiling or floor panel of a cooler. The panel 11 is seen to include a block of insulation 23 that is partially encased within a sheet metal cover 24. Again, the insulation 23 is preferably an expanded polymeric type insulative material such as polystyrene or polyurethane. A strip shaped section of the block, indicated generally at 25, is seen to be uncovered by the metallic cover and to be formed with a groove 26 shaped and sized to conform with the tongue 16 of the block of insulation 12 of panel 10. With this configuration, the two panels may be interfitted or mated in conventional tongue-and-groove fashion.

The panel 11 is formed with a fastener indicated generally at 30 which is comprised of a rectilinear, metallic loop 31 which is welded to a rigid, metallic plate 32 so as to project right angularly therefrom. The loop has a leg 33 welded flushly to the plate 32 from the opposite ends of which two arms 34 project to merge with a spanning pin 35. As shown here, the leg 33 is continuous so as to span the two arms 34. However, such is not necessary for the ends of the arms 34 may be themselves welded to the plate. The plate 32 is sandwiched between the cover 24 and the block of insulation 23.

In constructing the panel 11, the block of insulation 23 is formed and then the fastener 30 is mounted to the block. Where the insulation is relatively soft, as in the case of polyurethane, the loop 31 is simply driven into the block 23 until plate 32 is brought flushly against the surface of the block with the pin 35 part of the loop located transversely beneath groove 26. The metallic cover 24 is then mounted abut the block so as to overlay the plate 32. Where the insulation is of a realtively dense and hard nature, as in the case of polystyrene, a small slot is preferably formed in the insulation through which the loop 30 is passed with plate 32 sliding over the surface of the block in mounting the fastener. Alternatively, the fastener may be mounted in situ, i.e., molded in place as the insulation is formed into the block shape.

Figure 2:
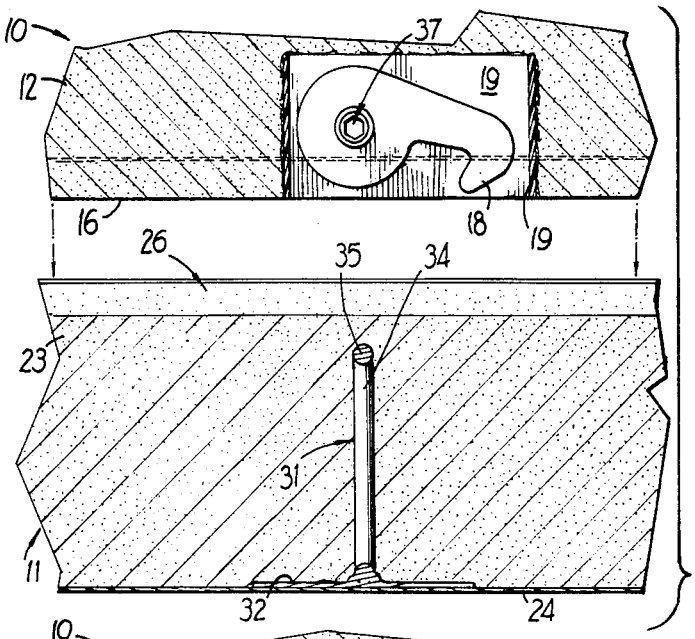
FIGS. 2–4 are cross-sectional views of a sequence of events that occur in interlocking the panels shown in FIG. 1.
Figure 3:
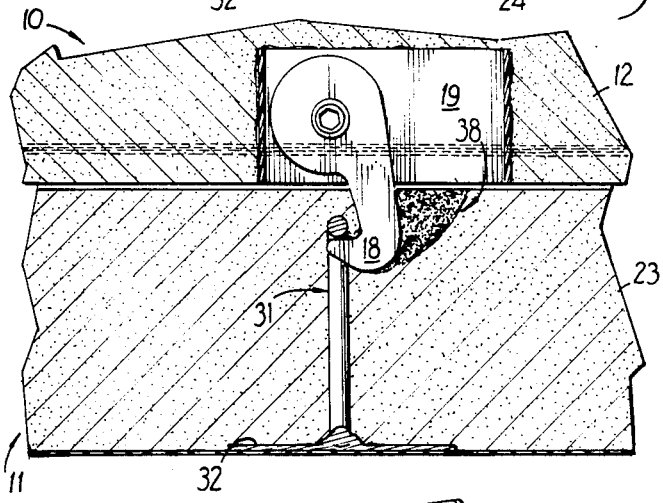
Figure 4:
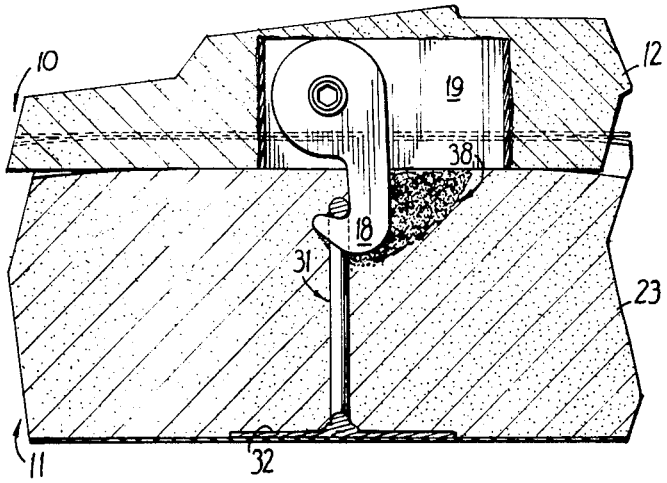

With reference next to FIGS. 2–4, a sequence of events is shown in fastening together the two panels 10 and 11. In FIG. 2 it is seen that the panel 10 is positioned right angularly and closely adjacent to the panel 11 in preparation for interfitting the two panels. Tongue 16 of the block 12 is then placed against the floor of groove 26 of the block 23 and wrench 20 then rotated within keyway 37. This causes the hook 18 to rotate clockwise, as shown in FIG. 3, and in doing so to form a slot or narrow trench within the body of insulation 23. After the hook 18 has engaged the pin portion 35 of loop 31, continued rotation of the eccentrically mounted hook causes it to move deeper into its casing, away from panel 11, thereby drawing the pin 35 towards panel 10. As this is done the force transmitted by the pin to plate 32 forces it against the surface of the block of insulation 23 located distal panel 10. In doing so the plate exerts a force over a wide surface area of block 23 thereby urging it tightly and flushly against the other panel 10. Once this is done the hook becomes detended in place whereupon the wrench 20 is removed leaving the panels 10 and 11 fastened tightly together as shown in FIG. 4.

It thus is seen that a new insulated panel and method of panel construction is provided which overcomes problems and limitations associated with those of the prior art. The pin fastener element may be mounted in a very simple and efficient manner without having to cut a cavity into its mounting. Instead, the pin may either be embedded by being slid into place through a small slot formed in the block or into the block without any precutting of the panel at all with the inplantation of the pin itself forming its own receiving cavity. Once mounted, no element of the pin assembly is visible thereby enhancing the appearance of the panel while leaving the pin assembly totally out of sight. If desired, a slight marking may be made so as to locate the pin position.

Though only one preferred embodiment of the invention has been illustrated, it should be understood that many modifications, additions and deletions may be made thereto without departure from the spirit and scope of the invention as set forth in the following claims.

I claim:

1. An insulated panel adapted to be interlocked with an adjacent panel that has a pivotable locking hook, and with said insulated panel comprising a block of insulation and a lock bar mounted to a plate with said plate set flush against one side of said block and with said lock bar embedded within said block adjacent the opposite side of said block, whereby the adjacent panel may be interlocked with the insulated panel by pivoting the locking hook into the block of insulation and into locking engagement with the embedded lock bar.

2. The insulated panel of claim 1 further comprising a sheet of metal overlaying said block one side and said plate.

3. The insulated panel of claim 1 wherein said block of insulation opposite side is formed with an elongated trough and wherein said bar is embedded transversely with respect to said elongated trough.

4. The insulated panel of claim 1 wherein said lock bar is in the shape of a rectilinear loop having a base leg welded to said plate from opposite ends of which two legs extend to a hook engaging leg oriented parallel with said base leg and plate.

5. A method of constructing an insulated panel of the type adapted to be interlocked with an adjacent panel that has a pivotable locking hook, and with the method comprising the steps of providing a block of insulation and a lock bar mounted to a plate, and mounting the lock bar and plate to the block of insulation by embedding the lock bar within the block and positioning the plate flushly against a surface of the block.

6. The method of constructing an insulated panel of claim 5 wherein the lock bar is embedded within the block by being pressed through the insulation.

7. The method of constructing an insulated panel of claim 3 wherein the lock bar is embedded within the block by being passed through a slot formed in the insulation.

8. The method of constructing an insulated panel in accordance with claim 3 further comprising the step of partially encasing the block and embedded lock bar within a metallic cover with the plate sandwiched between the cover and block.

* * * * *